US006581301B1

(12) United States Patent
Thorp

(10) Patent No.: US 6,581,301 B1
(45) Date of Patent: Jun. 24, 2003

(54) PAPER DRYING MACHINE

(75) Inventor: Benjamin A. Thorp, Richmond, VA (US)

(73) Assignee: Georgia-Pacific Corporation, Atlanta, GA (US)

( * ) Notice: Subject to any disclaimer, the term of this patent is extended or adjusted under 35 U.S.C. 154(b) by 136 days.

(21) Appl. No.: 09/717,786

(22) Filed: Nov. 21, 2000

(51) Int. Cl.[7] ..... F26B 3/00

(52) U.S. Cl. ..... 34/465; 34/454; 34/463; 34/488; 34/499; 34/114

(58) Field of Search ..... 34/454, 459, 463, 34/465, 487, 488, 499, 508, 114, 115, 620

(56) References Cited

U.S. PATENT DOCUMENTS

| | | | | | |
|---|---|---|---|---|---|
| 1,718,573 | A | | 6/1929 | Millspaugh | 162/207 |
| 3,303,576 | A | | 2/1967 | Sisson | 34/115 |
| 3,432,936 | A | | 3/1969 | Cole et al. | 34/6 |
| 4,202,113 | A | * | 5/1980 | Kankaanpaa | 24/456 |
| 4,481,723 | A | * | 11/1984 | Vedenpaa | 34/114 |
| 5,524,360 | A | * | 6/1996 | Virta | 34/457 |
| 5,636,452 | A | * | 6/1997 | Thorp et al. | 34/452 |
| 5,884,415 | A | * | 3/1999 | Sims | 24/117 |

OTHER PUBLICATIONS

W. P. Isler, "Through Air Drying–Proven Technology for a Superior Product", Tissue World 99, Mar. 1999.
D. E. Jewitt, "Through Air Drying–Value Adding Technology", Tissue World 99, Mar. 1999.

* cited by examiner

*Primary Examiner*—Ira S. Lazarus
*Assistant Examiner*—Kathryn S. O'Malley
(74) *Attorney, Agent, or Firm*—Banner & Witcoff, Ltd.

(57) ABSTRACT

A paper drying apparatus to dry a paper web carried on a fabric sheet includes a first rotatable drum to carry a paper web. A second rotatable drum is positioned downstream of the first drum with respect to the paper web carried by the first and second rotatable drum. A third rotatable drum is positioned downstream of the second rotatable drum to carry the paper web. A first air supply directs air through the first rotatable drum in a first direction to dry a paper web carried on the first rotatable drum. A second air supply supplies air through the second rotatable drum in a second direction opposite to the first direction. A third air supply supplies air through the third rotatable drum in the first direction. The first direction is one of a direction from an inside of a respective drum toward an outside of the respective drum and from the outside of the respective drum toward the inside of the respective drum.

9 Claims, 3 Drawing Sheets

PAPER DRYING MACHINE

BACKGROUND

Paper products, e.g., tissues, have conventionally been manufactured by forming a wet paper web on a fabric-carrying sheet, which then carries the paper web through a pressing section to remove the excess water from the web. After pressing the web to remove excess water, the paper web would then be fed to a separate drying section to fully remove the remaining moisture from the web. This step of pressing the web, however, reduces bulk and absorbency. Therefore, as opposed to leaving the web as a flat sheet on a single plane, rotatable air-heated drum dryers over which the web traveled were utilized in combination with an imprinting fabric sheet. Dryer hoods and air supply ducts are widely used in connection with these rotary drums, wherein pressurized drying air is introduced into the roll or at various points in the hood to contact one exposed surface of the wet web as it progresses around the dryer with the exit path for the air being positioned on the other side of the rotary drum. This process is known as through air drying (TAD).

U.S. Pat. No. 3,303,576 issued to Sisson discloses one such drying assembly in which a moving stream of pressurized drying air is circulated about a paper web traveling about the periphery of a rotatable roll having apertures formed therein. Sisson utilizes a system where the hot drying air travels from the inside of the rotatable roll to the outside through the apertures, while the web travels about the outer surface of the roll. With such rotatable rolls usually being composed of metal, this inside-to-outside type drying requires smaller diameter rolls because a larger diameter results in the web and fabric sheet lifting away from the roll surface at the air flows and pressures of commercial interest. Also, the drum metal is exposed to the full air temperature, which has adverse consequences with respect to maintenance and drum life.

U.S. Pat. No. 3,432,936 to Cole et al. avoids the problems with inside-to-outside drying by employing a configuration, which moves drying air from the exterior of a rotatable roll through the paper web and into the interior of the rotatable roll, otherwise known as outside-to-inside drying. Web and fabric sheet lifting do not impose airflow restrictions in outside-to-inside drying, because the air is blowing them onto the roll surface. Also, this configuration positions the metal rotatable roll on the cool side of the paper web, which allows for improved maintenance and drum life. However, when two or more of these rotatable rolls employing outside-to-inside drying are used, at least two carrying rolls must contact the paper web. Whenever wet paper webs contact carrying rolls, machine runability problems as well as product quality problems may be encountered.

One of the most important shortcomings associated with the above-described paper drying machine is that the paper web must come into contact with a carrying roll whenever more than one rotatable drying roll is employed. Further, machines that have one roll have limited drying capacity and are of limited commercial interest for that reason. Moreover, prior art machines employing multiple drying rolls have the drying air traveling in the same direction in each of the drying rolls used in such a machine. However, the most efficient use of space in these machines would be to use a combination of inside-to-outside drying rolls with outside-to-inside drying rolls. U.S. Pat. No. 1,718,573 issued to Millspaugh discloses a paper making machine which discloses removing moisture from a paper web in an outside-to-inside fashion using a suction roll followed by an inside-to-outside removal of moisture by forcing steam through the paper web as it passes over a blower roll. It should be noted, however, that the device disclosed by Millspaugh utilizes steam with its blower roll.

Because of the water content of steam, the medium cannot be used to dry a sheet to the required solids content. Furthermore, it is economically more efficient and proficient to employ heated air rather than a combination of air and steam when using a blowing device to dry a wet paper web.

U.S. Pat. No. 5,636,452 to Thorp et al. discloses a drying apparatus having two TAD rolls with one TAD employing inside-to-outside drying air and the other TAD roll employing outside-to-inside drying air. Thorp et al. is limiting in that its drying capacity is not sufficient to reach world class speeds found in present drying machines. The surface drying area of the two TAD rolls of Thorp et al. is less than that found in typical new TAD drying machines. Additionally, the configuration of Thorp et al. produces limited wrap of the paper web around its outside-to-inside drying drum, providing less drying surface area. In order to increase wrap, without the use of an outside roll that would touch the paper web, both TAD rolls of Thorp et al. are oriented at an angle. This leads to the need to have the exhaust hoods positioned at an angle as well, resulting in a complex and expensive design, especially when retrofitting existing machines.

It is an object of the present invention to provide a paper drying machine that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of preferred embodiments.

SUMMARY

The principles of the invention may be used to advantage to provide a drying machine having improved drying capacity. Such a construction advantageously permits all hoods of the dryer to be positioned in the customary vertical position, thereby significantly reducing the time and costs associated with retrofitting existing machines. This also provides greater flexibility, and takes advantage of vertical space, which is typically more available when retrofitting existing drying machines. Additionally, the present invention may provide greater wrap around its drying drums in certain embodiments. Further, the addition of a third TAD roll significantly increases the drying capacity of the machine.

In accordance with a first aspect, a paper drying apparatus to dry a paper web carried on a fabric sheet includes a first rotatable drum to carry a paper web. A second rotatable drum to carry the paper web is positioned downstream of the first rotatable drum with respect to the paper web carried by the first and second rotatable drums. A third rotatable drum to carry the paper web is positioned downstream of the second rotatable drum with respect to the paper web carried by the first, second, and third rotatable drums. A first air supply supplies air through the first rotatable drum in a first direction to dry the paper web. A second air supply supplies air through the second rotatable drum in a second direction opposite to the first direction to dry the paper web. A third air supply supplies air through the third rotatable drum in the first direction to dry the paper web. The first direction is from the inside of a respective drum toward the outside of the respective drum, or from the outside of the respective drum toward the inside of the respective drum.

In accordance with another aspect, a method for drying a paper web being carried on a fabric sheet includes the steps of guiding a paper web toward a first rotatable drum; passing the paper web over the first rotatable drum; forcing air through the paper web in a first direction, with the first direction being one of a direction from the inside of the first rotatable drum toward the outside of the first rotatable drum and the outside of the first rotatable drum toward the inside of the first rotatable drum; guiding the paper web from the first rotatable drum toward a second rotatable drum; passing the paper web over the second rotatable drum; forcing air through the paper web about the second rotatable drum in a second direction, the second direction being opposite to the first direction; guiding the paper web from the second rotatable drum toward a third rotatable drum; passing the paper web over the third rotatable drum; and forcing air through the paper web about the third rotatable drum in the first direction.

From the foregoing disclosure, it will be readily apparent to those skilled in the art, that is, those who are knowledgeable or experienced in this area of technology, that the present invention provides a significant advance. Preferred embodiments of the paper drying machine of the present invention can provide improved drying capacity, while reducing the cost of retrofitting existing paper drying machines. These and additional features and advantages of the invention disclosed here will be further understood from the following detailed disclosure of preferred embodiments.

BRIEF DESCRIPTION OF THE DRAWINGS

Preferred embodiments are described in detail below with reference to the appended drawings.

Figure 1:
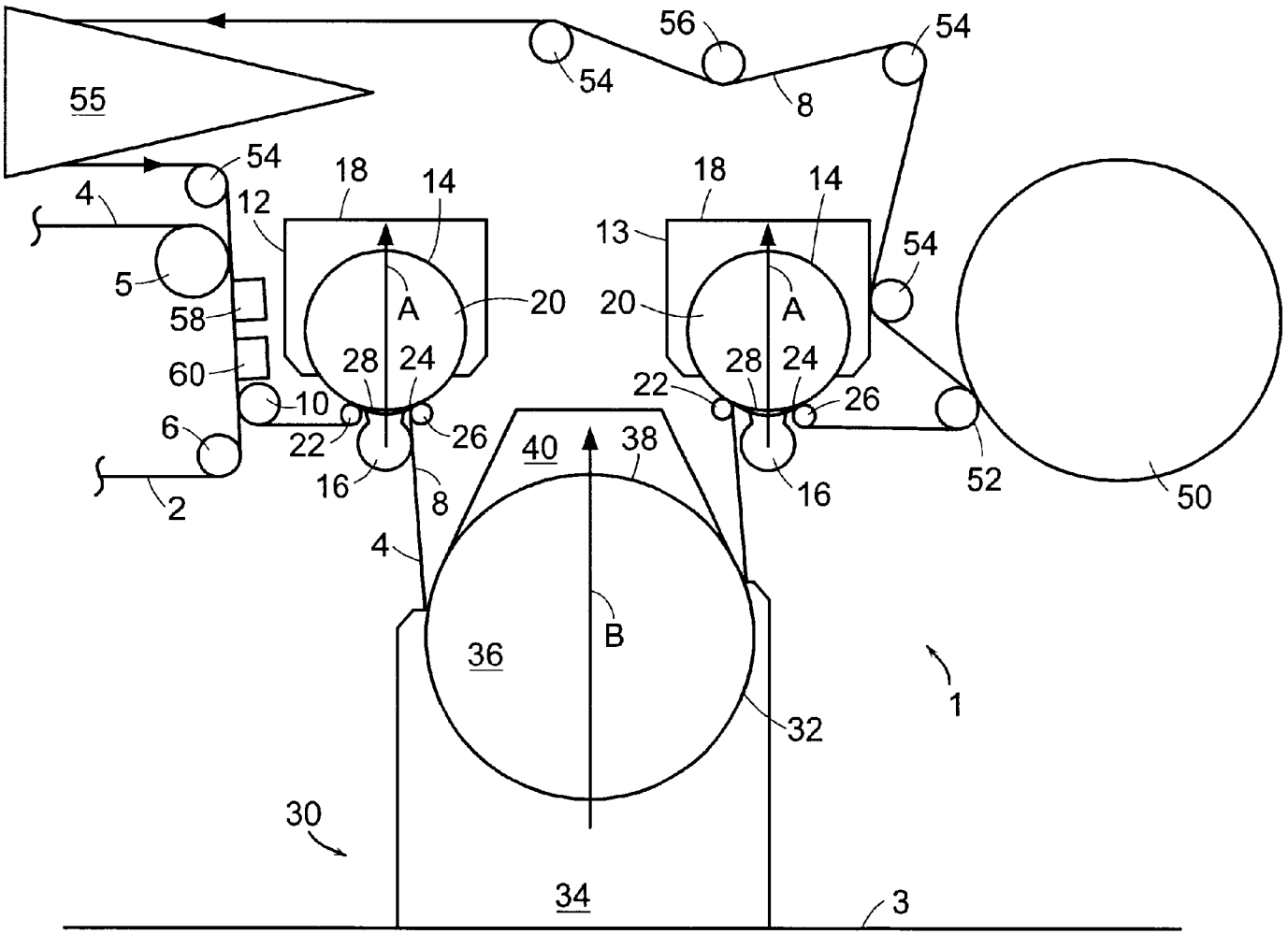
FIG. 1 is a schematic side view of a paper drying machine in accordance with a preferred embodiment of the present invention.

The figures referred to above are not drawn necessarily to scale and should be understood to present a representation of the invention, illustrative of the principles involved. Some features of the paper drying machine depicted in the drawings have been enlarged or distorted relative to others to facilitate explanation and understanding. The same reference numbers are used in the drawings for similar or identical components and features shown in various alternative embodiments. Paper drying machines as disclosed herein, will have configurations and components determined, in part, by the intended application and environment in which they are used.

DETAILED DESCRIPTION OF PREFERRED EMBODIMENTS

Referring now to FIG. 1, a paper drying device 1 in accordance with a preferred embodiment of the present invention is illustrated for removing moisture from a wet paper web 4, which is the product of a paper making machine, not shown here. Paper drying device 1 is supported on a floor or other surface 3. Paper web 4 is carried from a paper making process (not shown) to drying device 1 by a fabric sheet 2, wherein fabric sheet 2 travels about the perimeter of a couch roller 5 and a roller 6. In between rollers 5 and 6, paper web 4 is contacted by and transferred to a fabric sheet 8 as fabric sheet 8 passes by a pick-up device or shoe 10. Pick-up shoe 10 may comprise a transfer roller, transfer shoe or any other structure to transfer paper web 4 from fabric sheet 2 to fabric sheet 8. Such transfer devices often employ a vacuum to aid in the transfer of the paper web from one transfer fabric to another. Fabric sheet 8 conveys paper web 4 throughout drying device 1 and forms a closed loop through drying device 1, returning to the paper web transfer area at pick up shoe 10.

After paper web 4 is transferred to fabric sheet 8, fabric sheet 8 carries paper web 4 progressively through three drying chambers. As paper web 4 passes downstream through paper drying device 1, it passes through a first drying chamber 12, next through a second drying chamber 30, and then finally through a third drying chamber 13. First and third drying chambers 12, 13 have a similar construction, and each include a rotatable drum 14, a heated air supply 16, and an exhaust hood 18 for providing an exit for the heated air from within the respective drying chamber. Rotatable drum 14 has a porous surface permeable to air so that the drying air provided by air supply 16 passes through the surface of drum 14 and into the interior 20 of drum 14.

As paper web 4 enters first drying chamber 12, paper web 4 passes between a carrier roll 22 and rotatable drum 14. In order to minimize any machine downtime due to running problems, wet paper web 4 does not contact carrier roll 22. Rather, the path of fabric sheet 8 and that of paper web 4 are such that fabric sheet 8 contacts carrier roll 22 as fabric sheet 8 and web 4 pass by carrier roll 22, while the paper web 4 abuts and contacts rotatable drum 14. Thereafter, paper web 4 and fabric sheet 8 travel about the perimeter of drum 14 as it rotates within first drying chamber 12. After traveling about a substantial portion of the perimeter of the rotatable drum 14, paper web 4 and fabric sheet 8 exit first drying chamber 12 at 24, where paper web 4 and fabric sheet 8 pass between rotatable drum 14 and a carrier roll 26. Similar to the path of fabric sheet 8 as it enters first drying chamber 12, fabric sheet 8 remains in contact with carrier roll 26 while paper web 4 is abutting rotatable drum 14. Carrier rolls 22 and 26 are positioned with respect to rotatable drum 14 to create additional tension in fabric sheet 8 as it passes through first drying chamber 12, in order to maximize the contact between paper web 4 and the surface of rotatable drum 14. Additionally, the distance and angle of fabric sheet 8 between pick up shoe 10 and carrier roll 22 can be adjusted to accommodate various sized rotatable drums for desired drying characteristics.

First drying chamber 12, in the illustrated embodiment, employs through-air-drying 15 (TAD) to remove moisture from paper web 4 while it travels around the perimeter of rotatable drum 14. Thus, air supply 16 is situated between carrier rolls 22 and 26 so that air supply 16 forces air in the direction of arrow A into the interior 20 of drum 14 through a portion 28 of rotatable drum 14 on which fabric sheet 8 does not travel. The air then travels from the interior 20 of drum 14 through the porous surface of drum 14 in the direction of arrow A toward exhaust hood 18 in first drying chamber 12. Accordingly, after the air passes through the permeable surface of the drum, the air is forced through fabric sheet 8 and then through paper web 4, both of which are traveling about the surface of rotatable drum 14. The path of the drying air is known as inside-to-outside TAD, because the air is traveling from the inside of drum 14 to the outside of drum 14 while it is removing moisture from paper web 4. While the inside-to-outside drying air exits rotatable drum 14 and passes through paper web 4, the air applies a force to lift fabric sheet 8 and paper web 4 from the surface of drum 14, wherein the tautness of fabric sheet 8 resists this force and holds paper web 4 in abutment to drum 14. The restricting force due to the tension of fabric sheet 8 is calculated as F=T divided by R, where T is the tension of the fabric sheet in pounds per linear inch, and R is the radius of the roll in inches. Since this restraining force is inversely proportional to the roll radius, larger rolls have a lower restraining force. Therefore, rolls having inside to outside air flow typically have a diameter less than 10 feet.

After leaving first drying chamber 12, fabric sheet 8 next carries paper web 4 through a second drying chamber 30. Second drying chamber 30 also includes a rotatable drum 32 which employs TAD to further dry paper web 4; however, second drying chamber 30 employs outside-to-inside drying air, as opposed to the inside-to-outside drying air used in first drying chamber 12. Fabric sheet 8 enters second drying chamber 30 and travels about an outer surface of rotatable drum 32, wherein fabric sheet 8 is in abutment with the surface of rotatable drum 32. Second drying chamber 30 includes a heated air supply 34 which forces heated air, in the direction of arrow B, initially through paper web 4 as web 4 rotates through second drying chamber 30. The air then passes through fabric sheet 8, and finally the air passes through the air permeable surface of rotatable drum 32 into the interior 36 of drum 32.

After passing into the interior of drum 32, the air passes in the direction of arrow B through a portion 38 of rotatable drum 32 on which fabric sheet 8 does not travel, and subsequently exits second drying chamber 30 through an exhaust hood 40. Exhaust hood 40 extends around the portion 38 of rotatable drum 32 from where fabric sheet 8 enters rotatable drum 32 to where fabric sheet 8 exits rotatable drum 32. In certain preferred embodiments, the air can be removed from one or both roll journals of the drums (not shown), providing the opportunity to increase wrap in some configurations. Thus, exhaust hoods 40 are not necessary in all embodiments. While rotatable drum 32 may be similar in size to rotatable drum 14, rotatable drum 32 can be larger in diameter than drum 14, as the drying air does not exert a lifting force on the fabric sheet or paper web. A larger drum is generally more effective in removing moisture from the paper web.

After leaving second drying chamber 30, fabric sheet 8 next carries paper web 4 through third drying chamber 13. As noted above, the construction of third drying chamber 13 is similar to that of drying chamber 12, and, therefore, a discussion of third drying chamber 13 and the passage of paper web 4 therethrough need not be provided. In this embodiment, drying chambers 12 and 13 are positioned above drying chamber 30 with respect to surface 3. Thus, paper web 4 follows a reverse S shaped path about drying drum 14 in first drying chamber 12 and drying drum 32 in second drying chamber 30, and follows an S shaped path about drying drum 32 in second drying chamber 30 and drying drum 14 in third drying chamber 13.

After traveling through third drying chamber 13, fabric sheet 8 conveys paper web 4 from rotatable drum 14 to a final rotatable drying drum 50, a steam heated drum conventionally known as a Yankee or crepe dryer. Drum 50 typically has a hood (not shown), and provides the opportunity to crepe (also not shown). Drying drum 50 and its associated creping impart dry bulk, softness, drapability, and machine direction stretch to paper web 4. Fabric sheet 8 and paper web 4 proceed between the periphery of a pressure roll 52 and drying drum 50, wherein pressure roll 52 abuts fabric sheet 8 and transfers paper web 4 from fabric sheet 8 to the perimeter of drying drum 50. Paper web 4 then rotates along with the perimeter of drying drum 50 in a final drying procedure for paper web 4. Fabric sheet 8 then continues to travel along its loop about the perimeter of a series of carrier rolls 54, returning to pick up shoe 10 and then repeating the above stated process of drying paper web 4. As fabric sheet 8 travels back to pick up shoe 10, it passes through a fabric cleaning and conditioning device 55 to remove residual fibers, fabric release agents, and paper making chemicals from fabric sheet 8. In addition, a guide roll 56 is adjustably mounted so that its position may be altered to modify the position of fabric sheet 8 as it travels through the drying loop. There is also a stretch roll (not shown) to adjust the length and tension of fabric sheet 8. After passing through fabric cleaning and conditioning device 55, fabric sheet 8 is treated by shaping box 58. Shaping box 58 provides for wet shaping of paper web 4 by pulling the fibers of the web into interstices of fabric sheet 8. As paper web 4 is dried, voids, or pillows, are created in the web, providing increased absorbency for the paper web. Following shaping box 58, fabric sheet 8 is treated by vacuum box 60, providing additional de-watering and shaping of fabric sheet 8 if needed. It is to be appreciated that in certain preferred embodiments, the position of shaping box 58 and vacuum box 60 are reversed with respect to one another so that fabric sheet 8 is first treated by vacuum box 60 and then by shaping box 58.

In a preferred embodiment, the direction of each of arrows A and B, and, thus, the direction of airflow through the drying chambers, is substantially perpendicular to surface 3.

Consequently, each exhaust hood is located vertically above a corresponding air supply. In this configuration, drying chambers 12, 13, and 30 are considered to be aligned vertically with respect to surface 3 and drying device 1. The vertical orientation of the drying chambers allows greater use of vertical space in drying device 1, which is typically more available than horizontal space, especially in existing drying machines. This configuration enables existing drying machines to be retrofitted with TAD dryers in a cost effective manner, utilizing existing designs and avoiding costly reconstruction of these large and expensive machines. The minimal space required for this triple TAD roll configuration allows current paper drying machines to be adapted to include this improved configuration without having to move the large components in the drying process, such as the yankee dryer 50, while providing greater drying capacity. Therefore, the operational downtime of a paper drying machine which would result from adapting the paper drying machine to incorporate this improved triple TAD roll configuration would be minimal.

The configuration of the three TAD rolls in the present invention provides greater wrap about the drying drums and improved drying capacity. Preferred embodiments of the present invention can provide sufficient drying capacity to achieve world class speeds on the order of 4,000 to 5,000 feet per minute on 13 pound per 3,000 square feet tissue or towel product.

Figure 2:
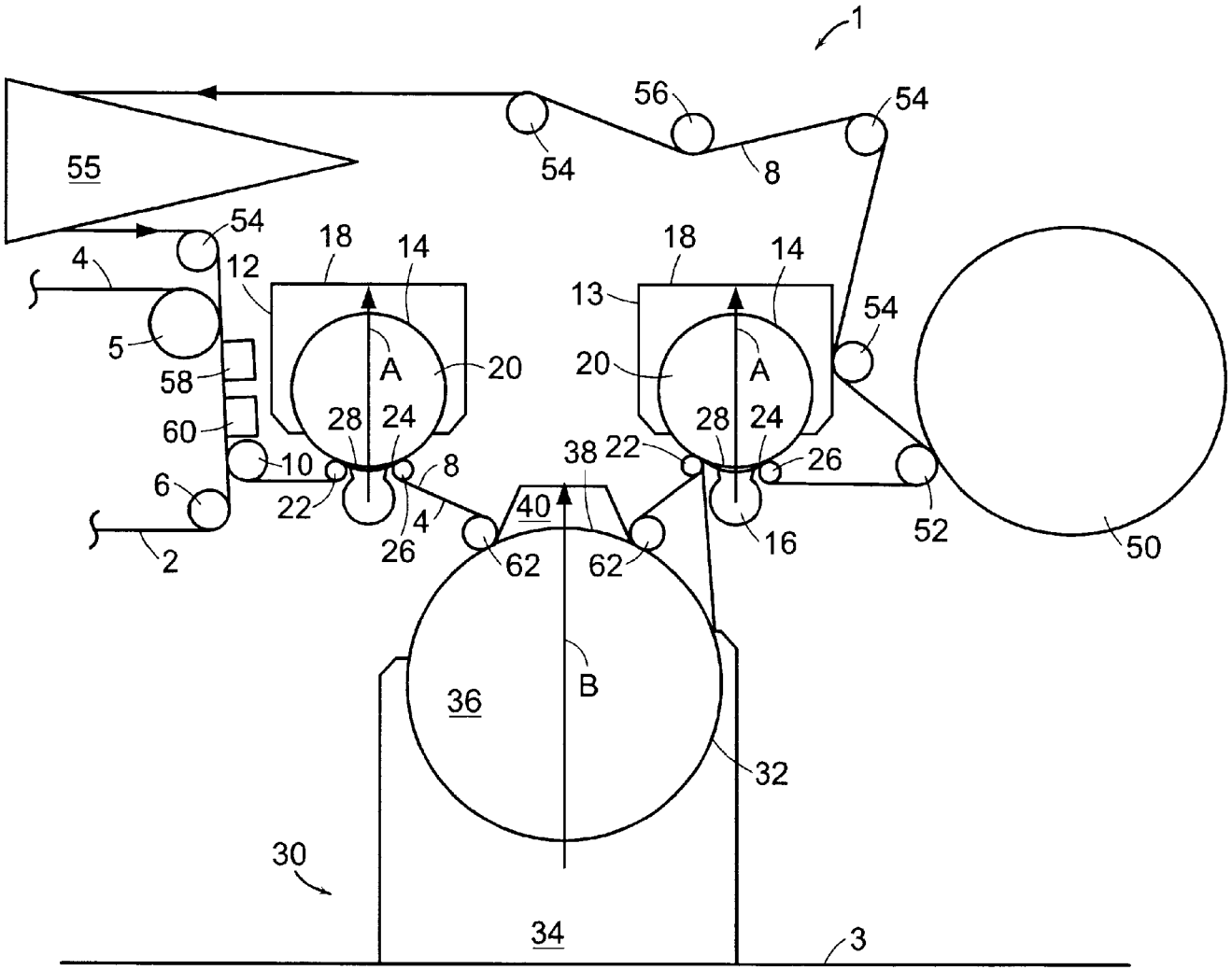
FIG. 2 is a schematic side view of an alternative embodiment of the paper drying machine of FIG. 1, shown with optional carrier rolls.

Another preferred embodiment of a paper drying device 1' is shown in FIG. 2. Paper drying device 1' has a similar construction to drying device 1 described above in conjunction with FIG. 2, with the addition of carrier rollers 62. Carrier rollers 62 support paper web 4 as it enters and exits drying chamber 30, providing additional wrap of paper web 4 about drum 32. It is to be appreciated that although paper drying device 1' is shown here with two carrier rollers 62, a single carrier roller 62 could be provided, either at the entrance or exit of drying chamber 30.

In another preferred embodiment, the wrap about rotatable drum 32 can be increased by positioning first and third drying drums 12, 13 closer to one another. This would increase the wrap about rotatable drum 32 without the use of carrier rollers 62.

In a further preferred embodiment, the wrap about the drying drums can be increased by removing the air from the drum through the journals of the drying drum, eliminating the need for exhaust hoods. This would allow the wrap of paper web 4 about the drums to be increased.

Figure 3:
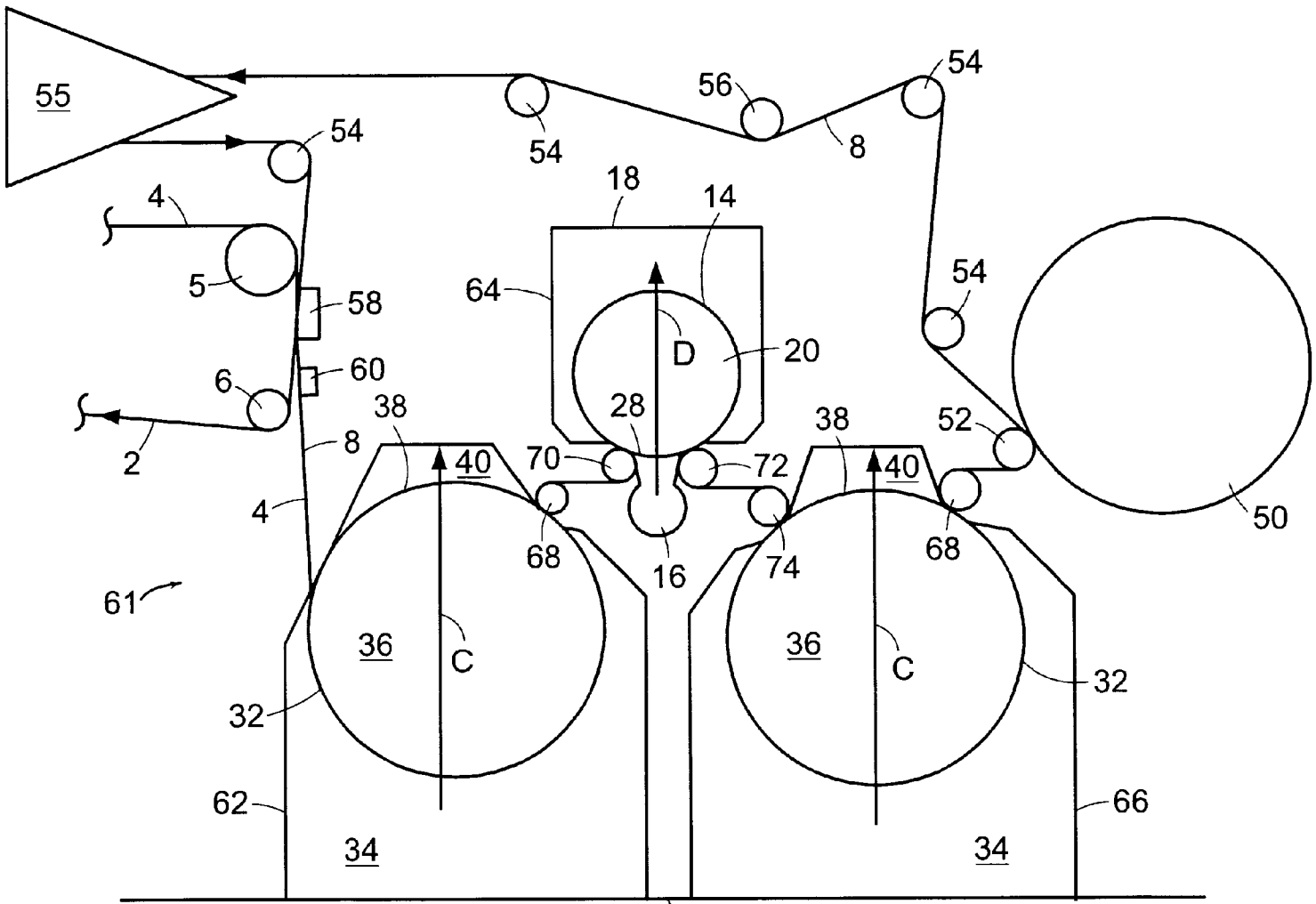
FIG. 3 is a schematic side view of a paper drying machine in accordance with another preferred embodiment of the present invention.

Another preferred embodiment of a paper drying device 61 is shown in FIG. 3. Whereas paper drying device 1, described above in conjunction with FIG. 1, has two inside-to-outside drying drums, with an outside-to-inside drying drum between them, paper drying device 61 has the reverse configuration. Specifically, paper drying device 61 has a first drying chamber 62 having an outside-to-inside drying drum 32, followed by a second drying chamber 64 having an inside-to-outside drying drum 14, which is then followed by a third drying chamber 66 having an outside-to-inside drying drum 32.

In the illustrated embodiment, vacuum box 60 provides the function of transferring paper web 4 from fabric sheet 2 to fabric sheet 8. First drying chamber 62 includes a rotatable drum 32, which employs TAD to dry paper web 4 using outside-to-inside drying air. Fabric sheet 8 enters first drying chamber 62 and travels about an outer surface of rotatable drum 32, wherein fabric sheet 8 is in abutment with the surface of rotatable drum 32. First drying chamber 62 includes a heated air supply 34 which forces heated air, in the direction of arrow C, initially through paper web 4 as web 4 rotates through first drying chamber 62. The air then passes through fabric sheet 8, and finally the air passes through the air permeable surface of rotatable drum 32 into the interior 36 of drum 32. After passing into the interior of drum 32, the air passes in the direction of arrow C through a portion 38 of rotatable drum 32 on which fabric sheet 8 does not travel, and subsequently exits first drying chamber 62 through an exhaust hood 40. Exhaust hood 40 extends around the portion 38 of rotatable drum 32 from where fabric sheet 8 enters rotatable drum 32 to where fabric sheet 8 exits rotatable drum 32. As fabric sheet 8 and paper web 4 exit first drying chamber 62, they pass between rotatable drum 32 and a carrier roll 68, with paper web 4 contacting carrier roll 68, and are passed to second drying chamber 64.

Second drying chamber 64 includes a rotatable drum 1.4 that utilizes inside-to-outside drying. Fabric sheet 8 contacts a carrier roll 70 as fabric sheet 8 and web 4 enter second drying chamber 64, while paper web 4 abuts and contacts rotatable drum 14. Thereafter, paper web 4 and fabric sheet 8 travel about the perimeter of drum 14 as it rotates within second drying chamber 64. After traveling about a substantial portion of the perimeter of the rotatable drum 14, paper web 4 and fabric sheet 8 exit second drying chamber 64, where paper web 4 and fabric sheet 8 pass between rotatable drum 14 and a carrier roll 72, with fabric sheet 8 contacting carrier roll 72. Air supply 16 forces air in the direction of arrow D into the interior 20 of drum 14 through a portion 28 of rotatable drum 14 on which fabric sheet 8 does not travel. The air then travels from the interior 20 of drum 14 through the porous surface of drum 14 in the direction of arrow D toward exhaust hood 18. Accordingly, after the air passes through the permeable surface of the drum, the air is forced through fabric sheet 8 and then through paper web 4, providing inside-to-outside drying for paper web 4.

Third drying chamber 66 has a construction similar to that of first drying chamber 62, and, therefore, utilizes outside-to-inside drying. However, third drying chamber 66 is additionally provided with a carrier roll 74, which contacts paper web 4 as fabric sheet 8 and paper web 4 enter third drying chamber 66, while fabric sheet 8 abuts and contacts rotatable drum 32. A further discussion of third drying chamber 66 and the passage of paper web 4 therethrough need not be provided. In this embodiment, first and third drying chambers 62 and 66 are positioned below second drying chamber 64 with respect to surface 3. Paper web 4 follows an S shaped path about drying drum 32 in first drying chamber 62 and drying drum 14 in second drying chamber 64, and follows a reverse S shaped path about drying drum 14 in second drying chamber 64 and drying drum 32 in third drying chamber 66.

Carrier rolls 68, 70, 72, and 74 are positioned, with respect to their respective rotatable drums, to create additional tension in fabric sheet 8 as it passes through each of the drying chambers, in order to maximize the contact between paper web 4 and the surface of the rotatable drums.

Such a configuration may be particularly advantageous given the space limitations in existing machines. For example, certain existing machines have two 12 ft. diameter TAD drums utilizing outside-to-inside drying. Such machines can handle speeds on the order of 3,000 to 4,000 fpm. The current state of the art speed is 4,500 fpm, which will likely increase to approximately 6,000 fpm. It may be physically impossible, or cost probative, to increase the size of the drying drums in such a machine. Such an existing machine can be retrofit through use of the present invention by adding a third, smaller diameter TAD drum utilizing inside-to-outside drying in available space above and between the existing TAD drums.

As can be seen from the foregoing, a drying apparatus for a paper web constructed in accordance with the present invention will provide TAD rolls in drying chambers that are aligned vertically with respect to the drying apparatus and the surface upon which it is supported, thus making the most efficient use of space with TAD rolls. This is especially important in retrofitting existing machines having a fixed distance between the transfer area, where the fabric sheet and paper web enter the drying area, and the Yankee dryer.

Such a configuration is also an improvement over TAD machines having a wet creping action followed by drying with no Yankee dryer or dry creping. The present invention provides an improved product with dry crepe, and, therefore, ample machine direction stretch for desired converting functions.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A paper drying apparatus to dry a paper web carried on a fabric sheet comprising, in combination:

a first rotatable drum to carry a paper web;

a second rotatable drum to carry a paper web, the second rotatable drum being positioned downstream of the first rotatable drum with respect to a paper web carried by the first and second rotatable drums;

a third rotatable drum to carry a paper web, the third rotatable drum being positioned downstream of the second rotatable drum with respect to a paper web carried by the first, second, and third rotatable drums;

a single fabric sheet to convey a paper web to the first rotatable drum, from the first rotatable drum to the second drum, from the second drum to the third rotatable drum, and from the third rotatable drum;

a first air supply to supply air through the first rotatable drum in a first direction from the outside of the first rotatable drum to the inside of the first rotatable drum to dry a paper web carried on the first rotatable drum, a second air supply to supply air through the second rotatable drum in a second direction from the inside of the second rotatable drum to the outside of the second rotatable drum to dry a paper web carried on the second rotatable drum; and a third air supply to supply air through the third rotatable drum in the first-direction from the outside of the third rotatable drum to the inside of the third rotatable drum to dry a paper web carried on the third rotatable drum.

2. The paper drying machine of claim 1, further comprising a surface upon which the paper drying apparatus is supported.

3. The paper drying machine of claim 2, wherein the first direction is substantially perpendicular to the surface.

4. The paper drying machine of claim 2, wherein the second direction is substantially perpendicular to the surface.

5. The paper drying machine of claim 2, wherein the first and third rotatable drums are positioned above the second drum with respect to the surface.

6. The paper drying machine of claim 2, wherein the first and third rotatable drums are positioned below the second drum with respect to the surface.

7. A method for drying a paper web being carried on a fabric sheet comprising the steps of:

guiding a paper web toward a first rotatable drum;

passing the paper web over the first rotatable drum;

forcing air through the paper web in a first direction from the outside of the first rotatable drum toward the inside of the first rotatable drum;

guiding the paper web from the first rotatable drum toward a second rotatable drum;

passing the paper web over the second rotatable drum;

forcing air through the paper web about the second rotatable drum in a second direction from the inside of the second rotatable drum to the outside of the second rotatable drum;

guiding the paper web from the second rotatable drum toward a third rotatable drum;

passing the paper web over the third rotatable drum; and forcing air through the paper web about the third rotatable drum in the first direction from the outside of the third rotatable drum to the inside of the third rotatable drum;

wherein the steps of guiding and passing the paper web are performed by a single fabric sheet.

8. The method of claim 7, wherein the first and third rotatable drums are positioned above the second rotatable drum with respect to a surface upon which each of the rotatable drums is supported.

9. The method of claim 7, wherein the first and third rotatable drums are positioned below the second rotatable drum with respect to a surface upon which each of the rotatable drums is supported.

* * * * *